US007134578B2

(12) United States Patent
Bougamont

(10) Patent No.: US 7,134,578 B2
(45) Date of Patent: Nov. 14, 2006

(54) PUMP FOR SEALING THE NECK OF A BOTTLE AND SPRAY PRODUCT PACKAGING COMPRISING SAID PUMP AND A BOTTLE

(75) Inventor: Jean-Louis Bougamont, Eu (FR)

(73) Assignee: Rexam Dispensing Systems S.A.S. (FR)

( * ) Notice: Subject to any disclaimer, the term of this patent is extended or adjusted under 35 U.S.C. 154(b) by 0 days.

(21) Appl. No.: 11/140,147

(22) Filed: May 27, 2005

(65) Prior Publication Data

US 2005/0274745 A1 Dec. 15, 2005

Related U.S. Application Data

(63) Continuation of application No. PCT/EP03/13815, filed on Nov. 24, 2003.

(30) Foreign Application Priority Data

Nov. 27, 2002 (FR) ..... 02 14857

(51) Int. Cl.
*B65D 88/54* (2006.01)

(52) U.S. Cl. ..... 222/321.9

(58) Field of Classification Search ..... 222/321.9
See application file for complete search history.

(56) References Cited

U.S. PATENT DOCUMENTS

| | | | | |
|---|---|---|---|---|
| 2,861,839 | A * | 11/1958 | Mellon | 222/321.9 |
| 6,196,424 | B1 * | 3/2001 | Bougamont et al. | 222/321.9 |
| 6,279,786 | B1 * | 8/2001 | de Pous et al. | 222/321.9 |
| 6,592,010 | B1 * | 7/2003 | Plessis | 222/321.9 |

FOREIGN PATENT DOCUMENTS

| | | |
|---|---|---|
| EP | 0 453 357 | 10/1991 |
| FR | 2 764 005 | 12/1998 |
| FR | 2 777 209 | 10/1999 |
| FR | 2 796 050 | 1/2001 |

OTHER PUBLICATIONS

International Search Report; May 3, 2004.

* cited by examiner

*Primary Examiner*—Philippe Derakshani
(74) *Attorney, Agent, or Firm*—St. Onge Steward Johnston & Reens LLC

(57) ABSTRACT

A pump intended to be assembled in the neck of a bottle containing a product to be sprayed. The pump includes a body made from flexible material containing the pumping mechanism, in which a rigid sleeve provided with a ring is embedded, the ring being able to form above it an annular space of sufficient dimensions to enable the body to work when assembled essentially under flexion.

6 Claims, 1 Drawing Sheet

PUMP FOR SEALING THE NECK OF A BOTTLE AND SPRAY PRODUCT PACKAGING COMPRISING SAID PUMP AND A BOTTLE

This application is a continuation of pending International Patent Application No. PCT/EP2003/013185 filed Nov. 24, 2003, which designates the United States and claims priority of French Patent Application No. 02/14857 filed Nov. 27, 2002.

FIELD OF THE INVENTION

The object of the present invention is a pump able to close off the neck of a bottle, and packaging for a product to be sprayed comprising the said pump and a bottle.

This pump is generally used in the field of cosmetics, associated with a bottle made from fragile material, often glass, containing a product to be sprayed. Such pumps, referred to as <<stopper>> pumps, intended to close off the neck of a bottle, are also referred to as <<closed>> pumps; the body of the pump encloses the pumping mechanism and a rigid sleeve is fitted in the said body in order to prevent any disconnection of the elements making up the said mechanism. These pumps can thus be pre-assembled before being supplied to the purchaser.

In order to guarantee the impermeability of the bottle on which they are mounted, the body of the pump is produced from flexible material. The rigid sleeve for its part is produced from a harder material, so as to protect the pumping mechanism. In order to immobilize these two elements with respect to each other, the rigid sleeve is provided on its external periphery with a projecting ring of small size, able to be embedded in the material of the body.

The object of the present invention is a pump able to close off the neck of a bottle, and packaging for a product to be sprayed comprising the said pump and a bottle.

This pump is generally used in the field of cosmetics, associated with a bottle made from fragile material, often glass, containing a product to be sprayed. Such pumps, referred to as <<stopper>> pumps, intended to close off the neck of a bottle, are also referred to as <<closed>> pumps; the body of the pump encloses the pumping mechanism and a rigid sleeve is fitted in the said body in order to prevent any disconnection of the elements making up the said mechanism. These pumps can thus be pre-assembled before being supplied to the purchaser.

In order to guarantee the impermeability of the bottle on which they are mounted, the body of the pump is produced from flexible material. The rigid sleeve for its part is produced from a harder material, so as to protect the pumping mechanism. In order to immobilize these two elements with respect to each other, the rigid sleeve is provided on its external periphery with a projecting ring of small size, able to be embedded in the material of the body made from flexible material, by means of which the rigid sleeve is anchored in the said body and cannot be disconnected from it despite the action of a spring in the pump mechanism.

The pump is supplied pre-mounted. It comprises the body made from flexible material in which the rigid sleeve is embedded. The pumping mechanism is installed in the said rigid sleeve.

The fitting of the pump takes place in accordance with the following steps:

The said pump is introduced inside the neck of the bottle. This introduction takes place forcibly and gives rise to a deformation of the body made from flexible material relating to its compression between the rigid sleeve and the neck of the bottle. Such necks are generally made from fragile material, principally glass, and, in order to prevent any risk of breakage of the glass neck, the ability of the flexible material to work under compression is essential. Nevertheless, it does happen that bottles are made with wide tolerances resulting in appreciable differences in the diameters of the necks. For necks with the smallest diameter, the degree of deformation of the body made from flexible material must be relatively great, the distance between the rigid sleeve and the neck of the bottle being particularly small. However, the flexible material may attain a kind of state of maximum deformation. From this state, the forces necessary for the deformation of the said body are greater than the stresses that can be withstood by the neck made from fragile material, the flexible material can then no longer deform and the neck breaks when the pump is introduced. The present invention proposes to resolve this problem. The invention thus concerns a pump able to close off the neck of a bottle comprising a body made from flexible material, the top part of which, after assembly of the pump in the neck, is held at the external edge of the neck, a pumping mechanism enclosed in the said body made from flexible material, and a rigid sleeve, interposed between the said pumping mechanism and the said body and provided with a ring embedded in the said body, characterized in that the said ring is able to form an annular space between the external surface of the said sleeve situated above the said ring and the opposite internal surface of the body, the said annular space having dimensions such that, after assembly, the radial distances between the said external body of the sleeve and the opposite internal surface of the neck of the bottle are greater than or equal to the thickness of the body made from flexible material, in the non-stressed state.

The role of the ring is essential and if, as in the prior art, it can serve to anchor the said rigid sleeve in the said body, here it serves above all to provide the annular space extending in height as far as the external edge of the neck and enabling the body made from flexible material not to work under compression, or only a little, but essentially under flexion. The forces necessary for the deformation of the body of the pump under flexion being appreciably less than those necessary for its compression, the neck of the bottle is preserved, whatever the tolerance with which it was manufactured.

Such pumps also guarantee a good seal on the bottle filled with the product to be sprayed.

The ring previously described, in order to fulfill its function, must have dimensions greater than those of the rings of the prior art which provided only an anchoring function. In addition, it must no longer necessarily have a projecting shape able to penetrate inside the flexible material. It is all the same preferable to preserve this type of shape, frustoconical for example; in this case, it is necessary to take account of the depth of penetration of the ring in the body made from flexible material, this having a direct influence on the volume of the annular space defined: the more the ring penetrates the flexible body, the more the volume decreases.

Advantageously, the top part of the body of the pump consists of a flange which comes into abutment against the external edge of the neck of the bottle. The rigid sleeve can also have at its top end a flange at least partly overlapping the said top part of the body. Thus the flange on the pump body is held between the external edge of the neck and the flange on the sleeve. In order to hold the top part of the pump body, it is however possible to envisage other types of solution such as for example the adhesive bonding of this top part to the external edge of the neck.

The annular space previously mentioned is defined between the external surface of the sleeve situated above the said ring and the internal surface of the body made from flexible material and extends in height as far as the external edge of the neck of the bottle. Advantageously, this height corresponds substantially to the height of the neck of the bottle, which enables the external surface of the body made from flexible material to best match the form of the internal surface of the neck, thus guaranteeing good holding of the pump inside the neck and a good seal.

A second object of the invention is a packaging of the product to be sprayed comprising a pump having the aforementioned characteristics and a bottle made from fragile material which may be glass.

Such a packaging has the advantages related to the use of a pump according to the invention.

BRIEF DESCRIPTION OF DRAWINGS

The invention and its advantages will be better understood from a reading of the detailed description of a preferred embodiment of the invention. The description which follows refers to the accompanying drawings in which.

DETAILED DESCRIPTION OF DRAWINGS

Figure 1:
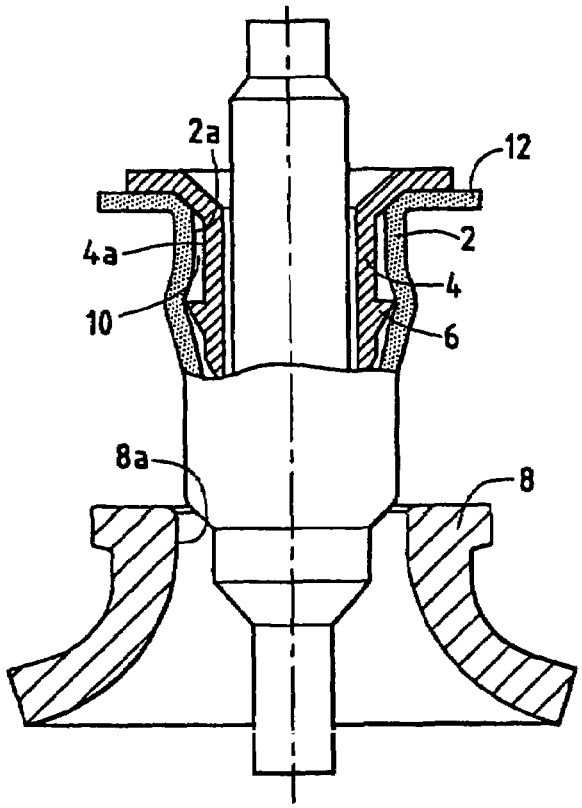
FIG. 1 depicts a transverse section of a pump according to the invention before it is assembled in the neck of the bottle

The pump as depicted in FIG. 1 comprises a body 2 made from flexible material containing the mechanism 3 of the pump, not shown and in which the rigid sleeve 4 provided with a ring 6 is embedded. This pump is able to close off the neck 8 of the bottle. The said ring 6 forms an annular space 10 between the external surface 4*a* of the said rigid sleeve 4 and the opposite internal surface 2*a* of the said body made from flexible material.

Figure 2:
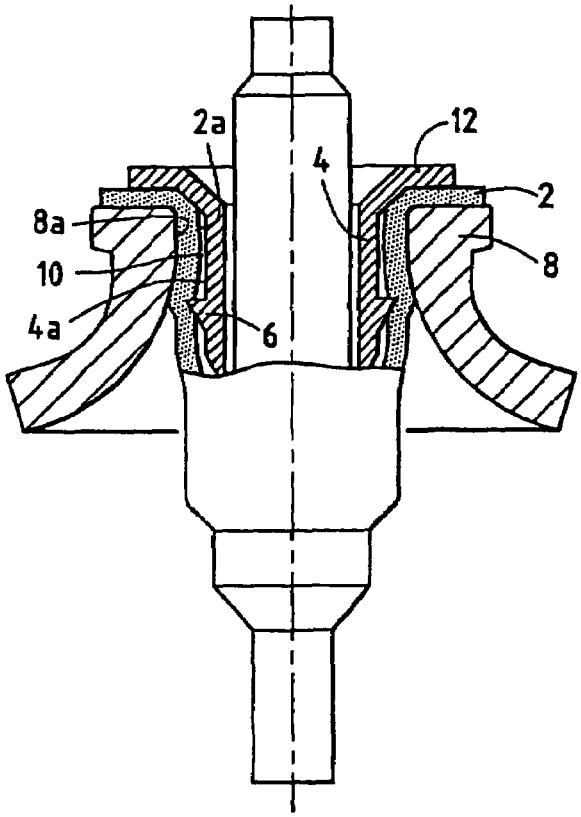
FIG. 2 depicts a transverse section of the pump in FIG. 1 after assembly in the neck of the bottle.

As depicted in FIG. 2, after assembly of the pump in the neck 8 of the bottle, and after the projecting ring 6 of frustoconical shape has penetrated inside the body 2, the annular space 10 remains, the radial distances between the external surface 4*a* of the sleeve 4 and the opposite internal surface 8*a* being greater than the thickness of the body 2 in the non-stressed state. Under these conditions the body 2 is working under flexion.

The top part of this body 2 according to a preferred embodiment of the invention is in the form of a flange and is held between the external edge 12 of the neck 8 and another flange situated at the top end of the rigid sleeve.

In general terms, the annular space 10 extends in height from the ring 6 as far as the level of the external edge of the bottle 21. Advantageously, as depicted in FIG. 2, the height of this space 10 corresponds substantially to the height of the neck 8, by means of which the body 2 perfectly matches the rounded part of the neck 8, thus providing better connection of the elements to each other and a good seal.

What is claimed is:

1. A pump able to close off the neck of a bottle comprising a body made from flexible material, the top part of which, after assembly of the pump in the neck, is held at the external edge of the neck, a pumping mechanism enclosed in said body made from flexible material, and a rigid sleeve interposed between said pumping mechanism and said body and provided with a ring embedded in said body characterized in that said ring is able to provide an annular space between the external surface of said sleeve situated above said ring and the opposite internal surface of the body, said annular space being of dimensions such that, after assembly, the radial distances between said external surface of the sleeve and the opposite internal surface of the neck of the bottle are greater than or equal to the thickness of the body made from flexible material, in the non-stressed state.

2. A pump according to claim 1, characterized in that said top part of the body made from flexible material consists of a flange.

3. A pump according to claim 1, characterized in that the rigid sleeve comprises at its top end a flange at least partly covering said top part of the body.

4. A pump able to close off the neck of a bottle according to claim 1, characterized in that the height of the annular space corresponds substantially to the height of the neck of the bottle.

5. Packaging of a product to be sprayed comprising a pump according to claim 1 and a bottle made of fragile material.

6. Packaging of a product to be sprayed comprising a pump according to claim 1 and a glass bottle.

* * * * *

UNITED STATES PATENT AND TRADEMARK OFFICE

CERTIFICATE OF CORRECTION

PATENT NO. : 7,134,578 B2
APPLICATION NO. : 11/140147
DATED : November 14, 2006
INVENTOR(S) : Jean-Louis Bougamont It is certified that error appears in the above-identified patent and that said Letters Patent is hereby corrected as shown below:

On The Title Page: Item (63) should read

-- Related U.S. Application Data: Continuation of application No. PCT/EP2003/013185, filed November 2003. --.

Signed and Sealed this

Sixth Day of February, 2007

JON W. DUDAS
*Director of the United States Patent and Trademark Office*